United States Patent [19]

Campbell

[11] Patent Number: 4,570,101

[45] Date of Patent: Feb. 11, 1986

[54] CATHODE-RAY TUBE HAVING A FACEPLATE PANEL WITH A SMOOTH ASPHERICAL SCREEN SURFACE

[75] Inventor: Francis J. Campbell, Lower Makefield Township, Bucks County, Pa.

[73] Assignee: RCA Corporation, Princeton, N.J.

[21] Appl. No.: 529,742

[22] Filed: Sep. 6, 1983

[51] Int. Cl.[4] ..... H01J 29/86

[52] U.S. Cl. ..... 313/461; 313/477 R

[58] Field of Search ..... 313/461, 477 R, 402; 220/2.14, 2.34

[56] References Cited

U.S. PATENT DOCUMENTS

| | | | |
|---|---|---|---|
| Re. 27,259 | 12/1971 | Rublack | 313/70 C |
| 2,728,012 | 12/1955 | Swedlund . | |
| 3,931,906 | 1/1976 | Brado . | |
| 4,136,300 | 1/1979 | Morrell | 313/403 |

FOREIGN PATENT DOCUMENTS

| | | | |
|---|---|---|---|
| 55-28269 | 2/1980 | Japan | 313/477 R |

*Primary Examiner*—William F. Smith

*Attorney, Agent, or Firm*—Eugene M. Whitacre; Dennis H. Irlbeck

[57] ABSTRACT

The present invention provides an improvement in a cathode-ray tube including a rectangular faceplate which has an exterior surface having curvature along both the minor and major axes. The faceplate also includes a cathodoluminescent screen on an interior surface thereof. At least in the center portion of the faceplate, the curvature along the minor axis is greater than the curvature along the major axis. In the improvement, points on the exterior surface near the ends of the minor and major axes, at the edges of the screen, lie in a first plane, and points on the exterior surface near the ends of the diagonals of the rectangular faceplate at the edges of the screen, lie in a second plane. The second plane is parallel to the first plane and is farther from the center portion of the faceplate than is the first plane.

3 Claims, 14 Drawing Figures

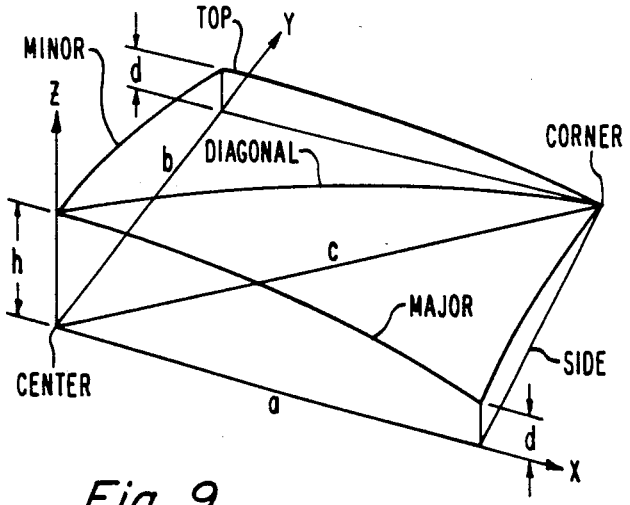
Fig. 9
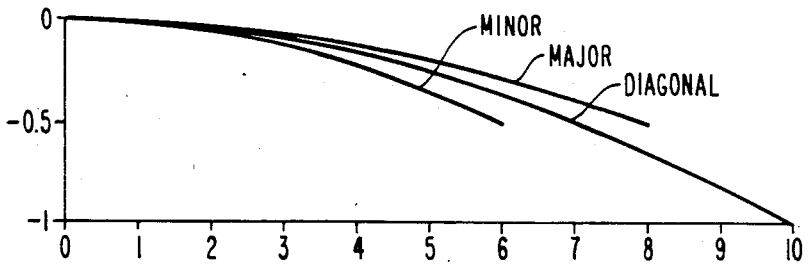
Fig. 10 w = 1
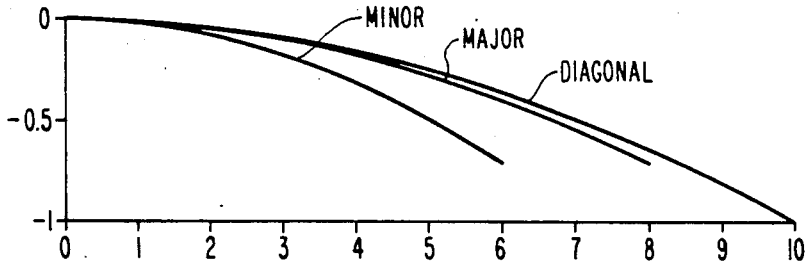
Fig. 11 w = 2

CATHODE-RAY TUBE HAVING A FACEPLATE PANEL WITH A SMOOTH ASPHERICAL SCREEN SURFACE

This invention relates to cathode-ray tubes (CRT's) and, particularly, to the surface contours of the faceplate panels of such tubes.

BACKGROUND OF THE INVENTION

There are two basic faceplate panel contours utilized commercially for rectangular CRT's of screen sizes greater than about a 23 cm diagonal: spherical, and cylindrical. Although flat contours are possible, the added thickness and weight of the faceplate panel required to maintain the same envelope strength are undesirable. Furthermore, if a flat faceplate CRT is a shadow mask color picture tube, the additional weight and complexity of an appropriate shadow mask also are undesirable.

A new faceplate panel contour concept is disclosed in three recently-filed copending U.S. Applications: Ser. No. 469,772, filed by F. R. Ragland, Jr. on Feb. 25, 1983; Ser. No. 469,774, filed by F. R. Ragland, Jr. on Feb. 25, 1983; and Ser. No. 469,775, filed by R. J. D'Amato et al. on Feb. 25, 1983 abandoned. The contour has curvature along both the major and minor axes of the faceplate panel, but is nonspherical. In a preferred embodiment described in these applications, the peripheral border of the tube screen is planar. In such tubes, it is important to contour the faceplate panel diagonals so that the differing curvatures extending from the major and minor axes are properly blended. In the above-cited U.S. Application Ser. No. 469,774, this blending is accomplished by permitting at least one sign change of the second derivative of the diagonal contour in the center-to-corner direction.

The present invention provides a novel faceplate panel contour which does not have an inflection along the diagonal contour.

SUMMARY OF THE INVENTION

The present invention provides an improvement in a cathode-ray tube including a rectangular faceplate which has an exterior surface having curvature along both the minor and major axes. The faceplate also includes a cathodoluminescent screen on an interior surface thereof. At least in the center portion of the faceplate, the curvature along the minor axis is greater than the curvature along the major axis. In the improvement, points on the exterior surface near the ends of the minor and major axes, at the edges of the screen, lie in a first plane, and points on the exterior surface near the ends of the diagonals of the rectangular faceplate at the edges of the screen, lie in a second plane. The second plane is parallel to the first plane and is farther from the center portion of the faceplate than is the first plane.

BRIEF DESCRIPTION OF THE DRAWINGS

FIG. 9 is a diagram of a panel quadrant.

FIGS. 10 to 14 are diagrams of different major axis, minor axis and diagonal curves of panels obtained by varying parameters in an equation described herein.

DETAILED DESCRIPTION OF THE PREFERRED EMBODIMENTS

Figure 1:
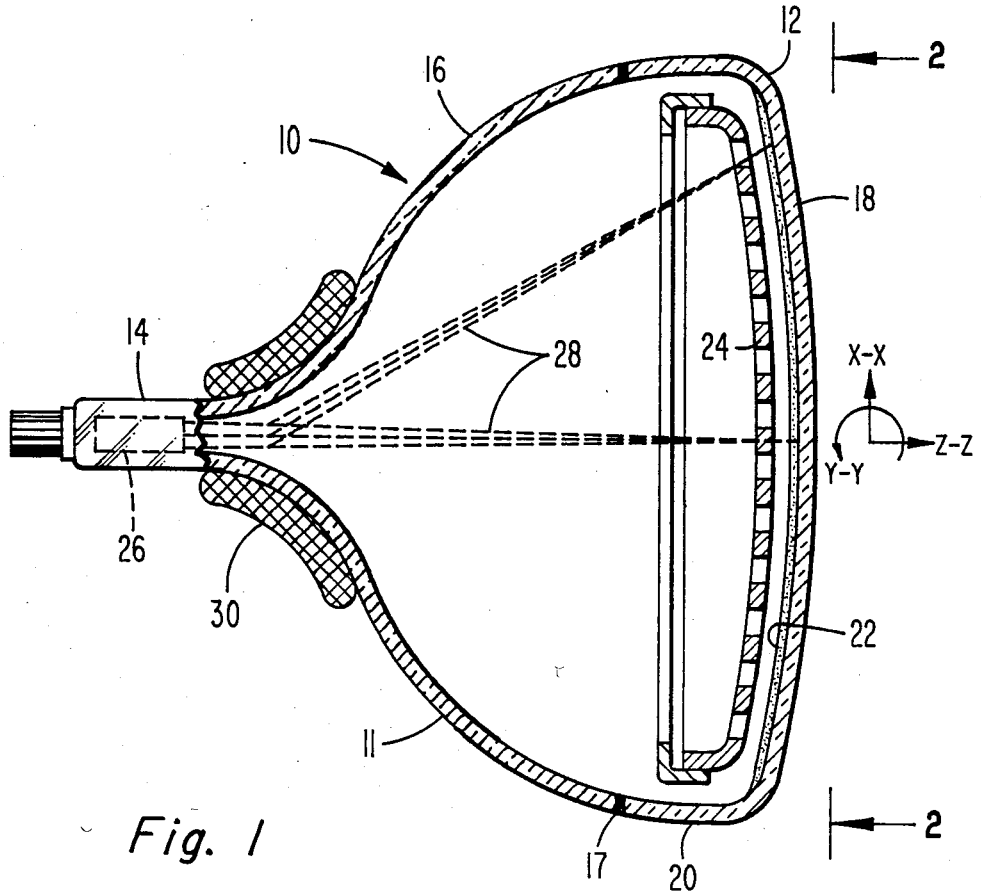
FIG. 1 is a plan view, partly in axial section, of a shadow mask color picture tube incorporating one embodiment of the present invention.

FIG. 1 shows a rectangular cathode-ray tube (CRT), in the form of a color picture tube 10 having a glass envelope 11, comprising a rectangular faceplate panel 12 and a tubular neck 14 connected by a funnel 16. The panel comprises a viewing faceplate 18 and a peripheral flange or sidewall 20, which is sealed to the funnel 16 by a glass frit 17. A rectangular three-color cathodoluminescent phosphor screen 22 is carried by the inner surface of the faceplate 18. The screen is preferably a line screen, with the phosphor lines extending substantially parallel to the minor axis Y—Y of the tube (normal to the plane of FIG. 1). Alternatively, the screen may be a dot screen. A multi-apertured color selection electrode or shadow mask 24 is removably mounted within the faceplate panel 12 in predetermined spaced relation to the screen 22. An inline electron gun 26, shown schematically by dotted lines in FIG. 1, is centrally mounted within the neck 14 to generate and direct three electron beams 28 along coplanar convergent paths through the mask 24 to the screen 22. Alternatively, the electron gun may have a triangular or delta configuration.

The tube 10 of FIG. 1 is designed to be used with an external magnetic deflection yoke, such as the yoke 30 schematically shown surrounding the neck 14 and funnel 16 in the neighborhood of their junction, for subjecting the three beams 28 to vertical and horizontal magnetic flux, to scan the beams horizontally in the direction of the major axis (X—X) and vertically in the direction of the minor axis (Y—Y), respectively, in a rectangular raster over the screen 22.

Figure 2:
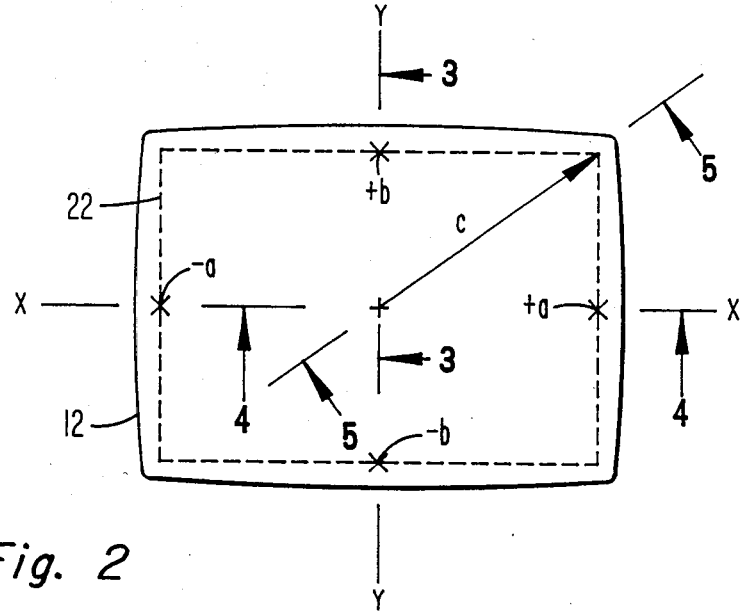
FIG. 2 is a front view of the faceplate panel of the tube of FIG. 1, taken at line 2—2 of FIG. 1.

FIG. 2 shows the front of the faceplate panel 12. The periphery of the panel 12 forms a rectangle with slightly curved sides. The border of the screen 22 is shown with dashed lines. This border is rectangular, with straight sides and square corners.

Figure 3:
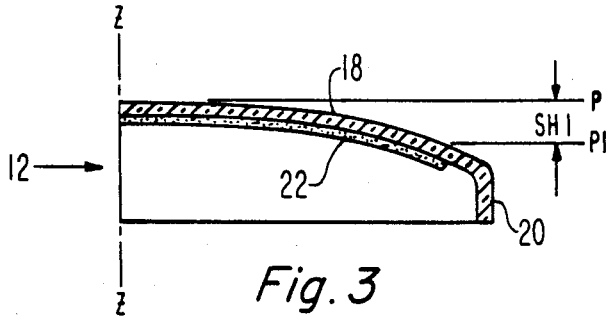
FIGS. 3, 4 and 5 are cross-sections of the faceplate panel of FIG. 2 taken at lines 3—3, 4—4 and 5—5, respectively, of FIG. 2.
Figure 4:
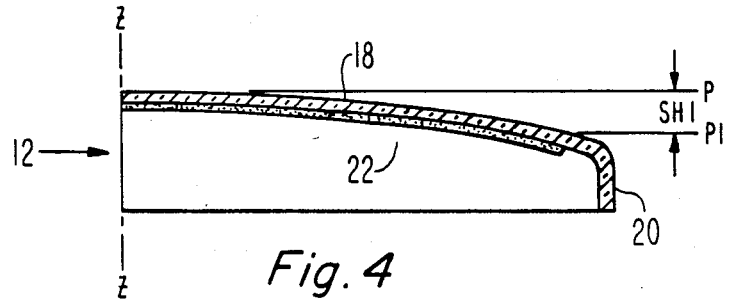
Figure 5:
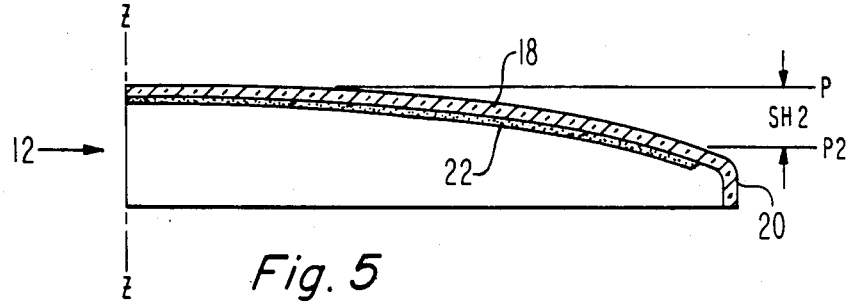

The specific contours along the minor axis (Y—Y), the major axis (X—X) and the diagonal are shown in FIGS. 3, 4 and 5, respectively. The exterior surface of the faceplate panel 12 is curved along both the major and minor axes, with the curvature along the minor axis being greater than the curvature along the major axis, at least in the center portion of the panel 12. For example, at the center of the faceplate, the ratio of the radius of curvature of the exterior surface contour along the major axis to the radius of curvature along the minor axis is greater than 1.1. The "sagittal height" of a point on the panel contour is measured, from a plane (P) which is perpendicular to the longitudinal axis Z—Z of the tube and tangent to the center of the panel 12, to another plane (e.g., P1 or P2) which is parallel to the plane P. The sagittal heights SH1 and SH2, for points on the exterior surface of the faceplate 18 near the ends of the minor axis, major axis and diagonal, at the edges of the screen 22, are indicated in FIGS. 3, 4 and 5, respectively.

The exterior surface contours along the major axis, the minor axis and the diagonal, as discussed herein, each ends at the edge of the screen. Both the major axis and the minor axis contours end at a first plane P1, which is perpendicular to the longitudinal axis Z—Z of the tube. The diagonal contour ends at a second plane P2, which is spaced from and parallel to the first plane P1. Points on the exterior surface near the ends of the major axis and the minor axis, at the edges of the screen, lie in the first plane P1. Points on the exterior surface near the ends of the diagonals, at the edges of the screen, lie in the second plane P2. In a preferred embodiment, the curvatures along the major axis, the minor axis and the diagonal are circular with the minor axis curvature having the shortest radius of the curvature and the diagonal having the longest radius of curvature.

Following is a derivation of equations for faceplate panels which have points near the ends of the major and minor axis, at the edge of the screen, lying in one plane and points near the ends of the diagonals, at the edge of the screen, which lie in a second plane that is farther from the center portion of the faceplate than is the first plane.

DERIVATION OF EQUATIONS DESCRIBING PANEL CONTOUR

Figure 6:
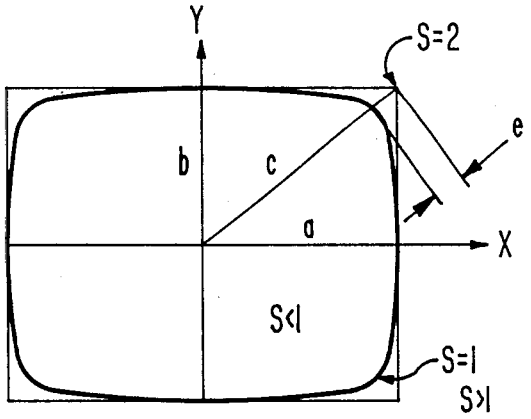
FIG. 6 is a diagram of a super ellipse curve.

A function s(x,y) is defined in the form $$s = \left(\frac{x^2}{a^2}\right)^u + \left(\frac{y^2}{b^2}\right)^v, \tag{1}$$

where u and v are two exponents, and a and b are two scale factors. The special curve s=1 describes a "super-ellipse" which is a closed curve in the xy plane. As shown in FIG. 6, s is less than 1 for all points inside the super-ellipse, and s is greater than 1 for all points outside. The super-ellipse intersects the x axis at $x=\pm a$, and the y axis at $y=\pm b$. Thus a and b are the semi-major and semi-minor axis lengths, respectively, which set the aspect ratio of the raster. NTSC standard is 4:3. A regular ellipse results if u=1, v=1, which becomes a circle is a=b. As the power u is raised, the top and bottom edges straighten out, and as the power v is raised, the left and right sides straighten out until finally the super-ellipse approaches a rectangle. In the square corners of the raster at $(x,y)=(\pm a, \pm b)$, s takes on the value 2.

Figure 7:
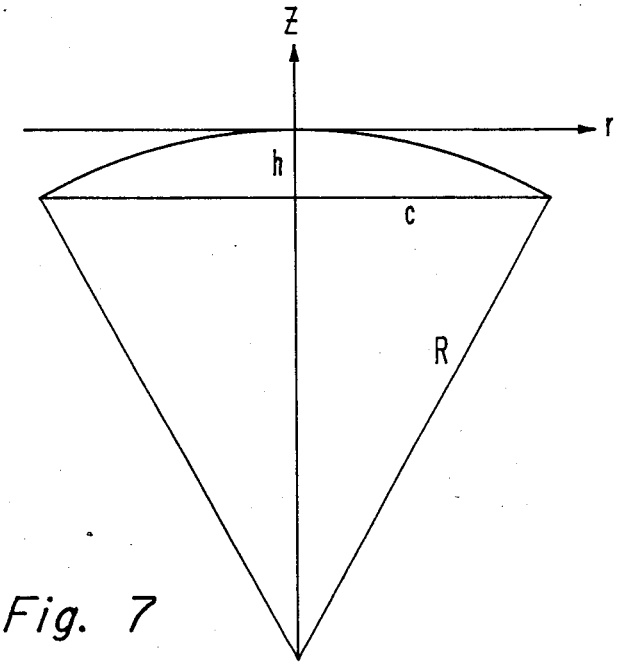
FIG. 7 is a diagram of a circularly curved panel.

By representing the surface height z as a function of s, a smooth surface is obtained that will intersect the z plane in a super-ellipse. To make this function as spherical as possible, especially along the diagonal, start with the equation of a circle of radius R, as shown in FIG. 7, $$(R+z)^2+r^2=R^2. \tag{2}$$

Here z=0 when r=0 with the circular arc curving backward toward negative z. The radius R, determined by the condition that $z=-h$ when $r=\pm c$, is $$R = \frac{c^2+h^2}{2h}, \tag{3}$$

where c is the half-diagonal determined from $$c^2=a^2+b^2. \tag{4}$$

The standard form of a circle along the screen diagonal becomes $$\frac{h}{c^2+h^2} z^2 + z + \frac{h}{c^2+h^2} r^2 = 0. \tag{5}$$

Figure 8:
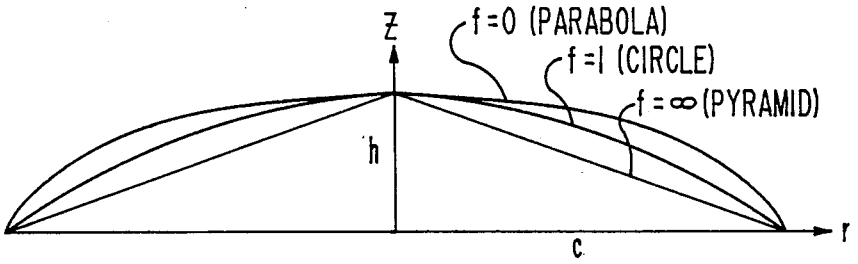
FIG. 8 is a diagram of panel shapes obtainable with an equation described herein.
Figure 12:
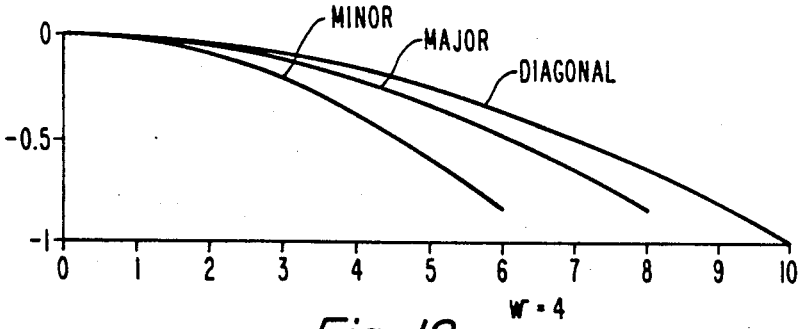
Figure 13:
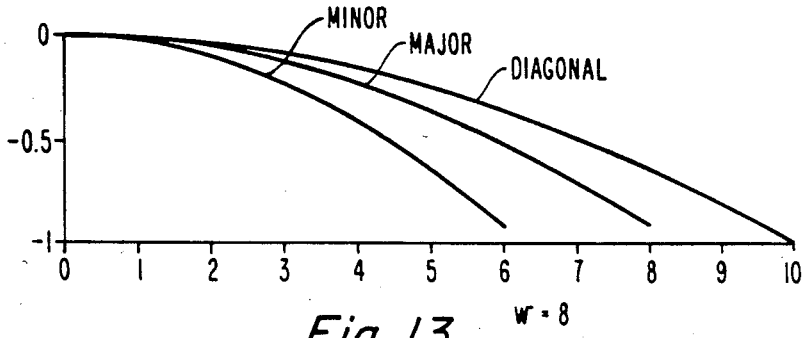
Figure 14:
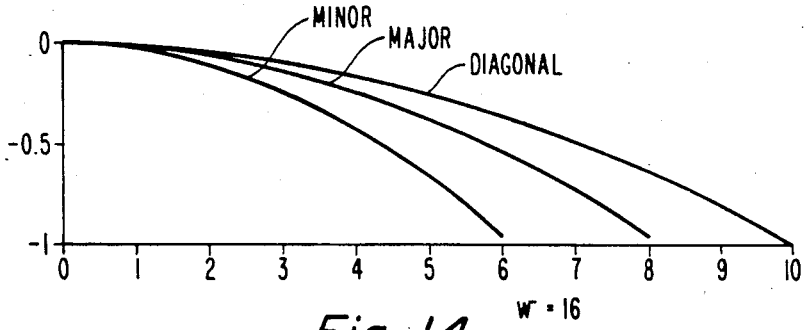

Now this equation is modified to the more general quadratic form $$\frac{p}{h} z^2 + z + (1-p)h\frac{r^2}{c^2} = 0, \tag{6}$$

where p is a dimensionless parameter given by $$p = \frac{h^2 f}{c^2+h^2}, \tag{7}$$

and f is a "flatness factor. When f=1, we get the circle of equation (5) back again. But if f=0, equation (6) describes the parabola $$z = -h\frac{r^2}{c^2}, \tag{8}$$

and as f approaches infinity, the curve turns into a pyramid $$z = -h\left|\frac{r}{c}\right| \tag{9}$$

with a sharp peak. These shapes, controlled by f, are shown in FIG. 8.

A general quadratic form of the panel equation, produced by replacing $r^2/c^2$ in equation (6) by a new parameter t, is $$\frac{p}{h} z^2 + z + h(1-p)t = 0, \tag{10}$$

where t is now defined in terms of the parameter s of the super-ellipse, itself a function of x and y, by $$t = \sqrt[w]{s/2}, \tag{11}$$

where w is now a power that should be close to the powers u and v so that t varies roughly as $x^2$, $y^2$ or $r^2$, depending on the ratios u and v to w.

The final panel function is the correct branch of the above quadratic through the origin, $$z = \frac{-2h(1-p)t}{1+\sqrt{1-4p(1-p)t}}, \tag{12}$$

which has the property that z=0 for t=0, and $z=-h$ for t=1. The panel thus curves backwards toward negative z to a sagittal height h in the square corner, as shown in FIG. 9.

From FIG. 6, the distance e along the diagonal from the super-ellipse (which lies in a plane) to the square corner, for the special case u=v=w, is given by $$e = c[1-(1/\sqrt{2})^{1/w}]. \tag{13}$$

The depth d of the square corner from the plane of the super-ellipse, also shown in FIG. 9, is $$d = h[2p - 1 + \sqrt{1 - 4p(1 - p)T}\ ]/2p, \quad (14)$$

where $T=(\frac{1}{2})^{1/w}$. This is also the maximum amount that the panel edge leaves the plane of a true rectangle.

Table 1 gives the distances e and d as a function of the power w for the special case u=v=w for a 685 mm (27 inch) diagonal screen with semi-major axis a=274 mm, semi-minor axis b=205.5 mm, sagittal height h=32 mm, and flatness factor f=1 (spherical diagonal).

TABLE 1

| Power w | e (mm) | d (mm) |
|---|---|---|
| 1 | 100.32 | 16.07 |
| 2 | 54.49 | 9.43 |
| 4 | 28.43 | 5.13 |
| 8 | 14.52 | 2.68 |
| 16 | 7.34 | 1.37 |

FIGS. 10 to 14 show the shape of the new panel surface along the major axis, the minor, and the diagonal for the above case, except here the panel is 8 by 6 with unity sagittal height. The distances d and e are proportional to those of Table 1.

What is claimed is:

1. In a cathode-ray tube including a rectangular faceplate wherein long sides of the faceplate substantially parallel a centrally located major axis of the tube and short sides of the faceplate substantially parallel a centrally located minor axis of the tube, said faceplate having an exterior surface having curvature along both its minor and major axes and said faceplate having a cathodoluminescent screen on an interior surface thereof, and wherein, at least in a center portion of the faceplate, the curvature along the minor axis is greater than the curvature along the major axis, the improvement comprising points on said exterior surface near the ends of the minor and major axes, at the edges of said screen, lying in a first plane and points on said exterior surface at the ends of the diagonals of said rectangular faceplate, at the edges of said screen, lying in a second plane, said second plane being parallel to said first plane and being farther from the center portion of the faceplate than is said first plane.

2. The tube as defined in claim 1, wherein the exterior surface along the major axis, the minor axis and the diagonals has circular curvatures.

3. The tube as defined in claim 2, wherein the surface curvature along the minor axis has the shortest radius of curvature and the surface curvatures along the diagonals have the longest radius of curvatures.

* * * * *